US009291388B2

(12) United States Patent
Rauch et al.

(10) Patent No.: US 9,291,388 B2
(45) Date of Patent: Mar. 22, 2016

(54) METHOD AND SYSTEM FOR AIR SEPARATION USING A SUPPLEMENTAL REFRIGERATION CYCLE

(71) Applicants: Jeremiah J. Rauch, Clarence, NY (US); Andrew M. Warta, Wheatfield, NY (US); Hao Wu, Shanghai (CN); David R. Parsnick, Amherst, NY (US); Sophia J. Dowd, Grand Island, NY (US)

(72) Inventors: Jeremiah J. Rauch, Clarence, NY (US); Andrew M. Warta, Wheatfield, NY (US); Hao Wu, Shanghai (CN); David R. Parsnick, Amherst, NY (US); Sophia J. Dowd, Grand Island, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 214 days.

(21) Appl. No.: 13/803,195

(22) Filed: Mar. 14, 2013

(65) Prior Publication Data

US 2013/0192301 A1 Aug. 1, 2013

Related U.S. Application Data

(63) Continuation-in-part of application No. 12/485,235, filed on Jun. 16, 2009, now Pat. No. 8,397,535.

(51) Int. Cl.

| | |
|---|---|
| ***F25J 3/00*** | (2006.01) |
| ***F25J 3/04*** | (2006.01) |
| *F25J 1/02* | (2006.01) |

(52) U.S. Cl.

CPC ..... *F25J 3/0409* (2013.01); *F25J 3/042* (2013.01); *F25J 3/04278* (2013.01); *F25J 3/04296* (2013.01); *F25J 3/04412* (2013.01); *F25J 3/04812* (2013.01); *F25J 1/025* (2013.01); *F25J 1/0249* (2013.01); *F25J 1/0251* (2013.01);

(Continued)

(58) Field of Classification Search

CPC ..... F25J 3/04812; F25J 3/0409; F25J 1/025; F25J 1/0251; F25J 1/0254; F25J 1/0255; F25J 1/0249; F25J 3/04278; F25J 3/042; F28F 9/026; F28D 9/0093

USPC ..... 62/643, 652, 903

See application file for complete search history.

(56) References Cited

U.S. PATENT DOCUMENTS

| | | | |
|---|---|---|---|
| 2,964,913 | A | 12/1960 | Smith |
| 5,678,425 | A | 10/1997 | Agrawal et al. |

(Continued)

FOREIGN PATENT DOCUMENTS

DE 10 2004 046 344 A1 3/2006

*Primary Examiner* — Frantz Jules
*Assistant Examiner* — Webeshet Mengesha
(74) *Attorney, Agent, or Firm* — Robert J. Hampsch; David M. Rosenblum

(57) ABSTRACT

A system and method for air separation using a supplemental refrigeration cycle is provided. A portion of the refrigeration required by the air separation plant to produce a liquid product stream is supplied via a supplemental refrigeration circuit configured to direct a cooled refrigerant produced by the turboexpander through the main heat exchanger of the air separation plant. The refrigeration capacity is controlled by removing or adding a portion of the refrigerant in the supplemental refrigeration circuit to adjust the inlet pressure while maintaining a substantially constant volumetric flow rate and substantially constant pressure ratio across the compressor. Removing the refrigerant from the supplemental refrigeration circuit decreases the refrigeration imparted by the supplemental refrigeration circuit and thus decreases the production of the liquid product stream. Adding refrigerant allows for an increase in the refrigeration imparted by the supplemental refrigeration circuit and thus allows for increased production of the liquid product stream.

9 Claims, 1 Drawing Sheet

(52) U.S. Cl.
CPC ..... *F25J1/0254* (2013.01); *F25J 1/0255* (2013.01); *F25J 2245/40* (2013.01); *F25J 2270/14* (2013.01); *F25J 2270/40* (2013.01)

(56) References Cited

U.S. PATENT DOCUMENTS

| | | | | |
|---|---|---|---|---|
| 5,758,515 | A | 6/1998 | Howard | |
| 5,791,160 | A * | 8/1998 | Mandler et al. | 62/611 |
| 5,806,341 | A | 9/1998 | Rathbone | |
| 6,053,008 | A * | 4/2000 | Arman et al. | 62/646 |
| 6,125,656 | A * | 10/2000 | Arman et al. | 62/647 |
| 6,257,020 | B1 | 7/2001 | Tranier | |
| 6,357,258 | B1 * | 3/2002 | Mahoney et al. | 62/643 |
| 6,718,795 | B2 | 4/2004 | Briglia | |
| 6,779,361 | B1 | 8/2004 | Skare et al. | |
| 2005/0097904 | A1 | 5/2005 | Lifson et al. | |
| 2007/0157664 | A1 * | 7/2007 | Howard | 62/646 |
| 2008/0000266 | A1 * | 1/2008 | Dee et al. | 62/643 |
| 2010/0313600 | A1 | 12/2010 | Howard et al. | |
| 2011/0041523 | A1 * | 2/2011 | Taras et al. | 62/77 |

* cited by examiner

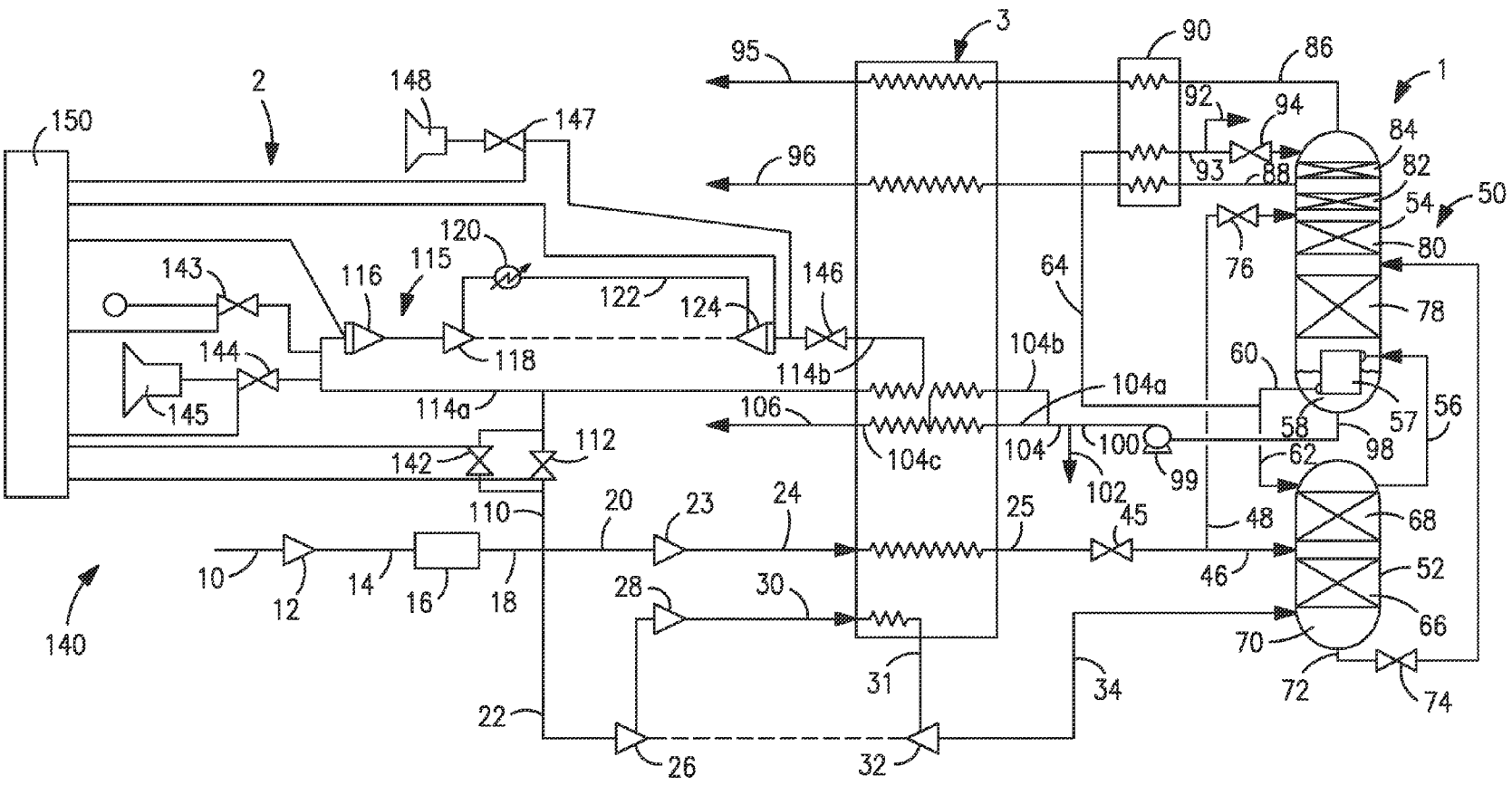
1
2
3
10
12
14
16
18
20
22
23
24
25
26
28
30
31
32
34
45
46
48
50
52
54
56
57
58
60
62
64
66
68
70
72
74
76
78
80
82
84
86
88
90
92
93
94
95
96
98
99
100
102
104
104a
104b
104c
106
110
112
114a
114b
115
116
118
120
122
124
140
142
143
144
145
146
147
148
150

METHOD AND SYSTEM FOR AIR SEPARATION USING A SUPPLEMENTAL REFRIGERATION CYCLE

CROSS REFERENCE TO RELATED APPLICATIONS

The present application is a continuation-in-part application from U.S. patent application Ser. No. 12/485,235 filed Jun. 16, 2009, issued on Mar. 19, 2013 as U.S. Pat. No. 8,397,535; the disclosure of which is incorporated by reference herein.

FIELD OF THE INVENTION

The present invention relates to a method and system for air separation involving production of a liquid product stream by using a supplemental refrigeration cycle. More particularly, the present invention relates to a supplemental refrigeration cycle that circulates a refrigerant or working fluid at a substantially constant volumetric flow rate and also maintains the pressure ratio across the compressor section substantially constant by removing or adding the working fluid or refrigerant from or to the supplemental refrigeration circuit to adjust the liquid product make in the air separation plant.

BACKGROUND

Oxygen is separated from oxygen containing feeds, such as air, through cryogenic rectification. In order to operate a cryogenic rectification plant, refrigeration must be supplied to offset ambient heat leakage, warm end heat exchange losses and to allow the extraction or production of liquid products, including liquid oxygen, liquid nitrogen, or liquid argon. While the main source of refrigeration for a cryogenic rectification plant is typically supplied by expanding part of the feed air stream or a waste stream to generate a cold stream that is then introduced into the main heat exchanger or the distillation column, external refrigeration can also be imparted by other refrigerant streams introduced into the main heat exchanger, including a refrigerant stream from a closed loop supplemental refrigeration cycles as generally described in U.S. Pat. No. 8,397,535.

One of the limitations or drawbacks of the existing supplemental refrigeration cycles used in air separation plants is that the centrifugal compressors and turboexpanders in such supplemental refrigeration circuits are generally operating in an 'on' or 'off' mode. In other words, the centrifugal compressors and turboexpanders are either operating so as produce the supplemental refrigeration and additional liquid product make or are shut down thereby not producing supplemental refrigeration and foregoing any additional liquid product make. The continued cycling of the centrifugal compressors and turboexpanders between operating mode and shut-down mode adversely impacts the overall efficiency and reliability of the supplemental refrigeration cycle.

A small degree of adjustment in existing supplemental refrigeration circuits may be achieved through the adjustment of compressor inlet guide vanes. However, one must be careful of adjustments that would sent the compressor into a surge condition or a stonewall conditions as a result of too little or too much flow to the compressor. As a result, the existing or prior art supplemental refrigeration circuits are generally operated at a fixed or near-fixed operating point. This inability to modulate the level of supplemental refrigeration over broad operating ranges effectively limits the plant operator from precisely controlling the amount of liquid product produced by the air separation plant at any given time.

What is needed, therefore, is a supplemental refrigeration circuit or system adapted for use in air separation plants that facilitates modulating the level of supplemental refrigeration produced over broad operating ranges and thus allows more precise control of the amount of liquid product produced by the air separation plant at any given moment.

SUMMARY OF THE INVENTION

The present invention may be characterized as a method of separating air comprising: (a) conducting a cryogenic rectification process in an air separation plant comprising a main heat exchanger to cool a compressed and purified feed air stream to a temperature suitable for the rectification and a distillation column system configured to rectify the compressed, purified and cooled air to produce at least one liquid product stream; (b) providing a portion of the refrigeration required by the air separation plant to produce the at least one liquid product stream via a supplemental refrigeration circuit configured to direct a cooled working fluid through the main heat exchanger; (c) warming the cooled working fluid in the main heat exchanger to impart the portion of the refrigeration required by the air separation plant; (d) recirculating the warmed working fluid to a compressor section of the supplemental refrigeration circuit; and (e) removing or adding a portion of the working fluid in the supplemental refrigeration circuit.

The removal of the working fluid from the supplemental refrigeration circuit or the adding of the working fluid to the supplemental refrigeration circuit is controlled to adjust the inlet pressure commensurate with the desired level of liquid product production while the working fluid circulates at a substantially constant volumetric flow rate and the pressure ratio across the compressor section is maintained substantially constant. Removing the working fluid from the supplemental refrigeration circuit upstream of a turboexpander section decreases the refrigeration imparted by the supplemental refrigeration circuit to the main heat exchanger and the air separation plant and thus decreases the production of the liquid product stream. Conversely, adding working fluid to the supplemental refrigeration circuit upstream of the compressor section increases the refrigeration imparted by the supplemental refrigeration circuit and thus allows for increased production of the liquid product stream.

The invention may also be characterized as an air separation plant configured to produce a liquid product stream, the air separation plant comprising: (i) an air intake circuit configured to compress and purify an incoming feed air stream; (ii) a distillation column system configured to rectify the compressed and purified feed air stream by a cryogenic rectification process to produce the liquid product stream; (iii) a main heat exchanger operatively associated with the compressed and purified feed air stream and distillation column system and configured to cool the compressed and purified feed air stream to a temperature suitable for the rectification; (iv) a supplemental refrigeration circuit coupled to the main heat exchanger and comprising a compressible working fluid, a compressor section configured to compress the working fluid, and a turboexpander section configured to expand the working fluid to generate cooled working fluid used to provide supplemental refrigeration to the main heat exchanger and the air separation plant. The cooled working fluid is warmed in the main heat exchanger so as to impart that portion of the refrigeration required by the air separation plant to produce the liquid product stream. The warmed working fluid is then recirculated to the compressor section of the supplemental refrigeration circuit after having passed through the main heat exchanger.

The present invention also includes a vent system disposed upstream of the turboexpander section and configured for removing a portion of the working fluid from the supplemental refrigeration circuit and a source of working fluid coupled via one or more control valves upstream of the compressor section and configured for adding working fluid to the supplemental refrigeration circuit. A controller is operatively connected to the vent system and control valves and configured or adapted to control the removal or addition of working fluid to adjust the inlet pressure while maintaining a substantially constant volumetric flow rate of the working fluid through the compressor section and turboexpander section of the supplemental refrigeration circuit and a substantially constant pressure ratio across the compressor section.

As indicated above, removal a portion of the working fluid decreases the refrigeration imparted by the supplemental refrigeration circuit and thus decreases the production of the liquid product stream whereas adding working fluid to the supplemental refrigeration circuit increases the refrigeration imparted by the supplemental refrigeration circuit and thus increases the production of the liquid product stream.

There are numerous additional features, functions and optional elements or steps associated with the removal of working fluid from or adding working fluid to the supplemental refrigeration circuit. For example, removal of the working fluid may be accomplished by venting a portion of the working fluid in the supplemental refrigeration circuit upstream of the turboexpander section to maintain the working fluid in the supplemental refrigeration circuit at or below a prescribed maximum pressure. Similarly, it may be useful to vent a portion of the working fluid downstream of the turboexpander section of the supplemental refrigeration circuit to maintain the working fluid in the supplemental refrigeration circuit at or below a prescribed maximum pressure and to maintain the cooled working fluid directed to the main heat exchanger at or below a prescribed maximum temperature.

Preferably, adding working fluid to the supplemental refrigeration circuit may be accomplished by charging the supplemental refrigeration circuit with working fluid supplied from the compressed and purified feed air stream and thereafter modulating the supply of the compressed and purified feed air stream to the supplemental refrigeration circuit to adjust the inlet pressure to the compressor section. Alternatively, adding working fluid to the supplemental refrigeration circuit may be accomplished by adding a flow of make-up working fluid to the supplemental refrigeration circuit upstream of the compressor section to maintain the inlet pressure to the compressor section at or above a prescribed minimum pressure.

Still other features, elements, techniques and steps associated with maintaining the substantially constant volumetric flow rate of working fluid and/or maintaining substantially constant pressure ration across the compressor section of the supplemental refrigeration circuit can be optionally employed. For example, adjusting compressor guidevanes in the compressor section can be used to maintain the substantially constant pressure ratio across the compressor section. Also, adjusting turbine nozzle arrangements in the turboexpander section of the supplemental refrigeration circuit may be employed to maintain substantially constant volumetric flow rate.

In short, the above-identified features, elements, techniques and steps are preferred examples of operatively controlling the amount of additional refrigeration required by the air separation plant to produce the liquid product stream. Controlling the removal of working fluid, the addition of working fluid, the adjusting of compressor guidevanes, and the adjusting of turbine nozzles is preferably accomplished via a controller or other control means to maintain a substantially constant pressure ratio across the compressor and substantially constant volumetric flow rate in the supplemental refrigeration circuit.

BRIEF DESCRIPTION OF THE DRAWINGS

While the present invention concludes with claims distinctly pointing out the subject matter that Applicants regard as their invention, it is believed that the invention will be better understood when taken in connection with the accompanying drawing (FIG. 1) which is a schematic process flow diagram of a cryogenic rectification plant in which a supplemental refrigeration cycle in accordance with the present invention.

DETAILED DESCRIPTION

With reference to FIG. 1, a cryogenic air separation plant 1 is illustrated that is integrated with a supplemental refrigeration circuit or system 2 which is designed to increase production of liquid products from the air separation plant 1. This integration is accomplished with the use of a heat exchanger 3 that is provided with layers that allow subsidiary streams of pumped liquid oxygen to reach a temperature that exceeds either at the dew point or the critical temperature of the pumped liquid oxygen and then combine such subsidiary streams to leave regions of layers free for warming a refrigerant stream produced in the closed loop refrigeration cycle.

In the air separation plant 1, a feed air stream 10 is introduced into a cryogenic air separation plant 1 to separate oxygen from the nitrogen. Air stream 10 is preferably compressed within an intercooled, integral gear compressor 12 to a pressure that can be between about 5 bar(a) and about 15 bar(a). After compression, the resultant compressed feed air stream 14 is introduced into a prepurification unit 16. A pre-purification unit 16, as is well known in the art, typically contains beds of alumina and/or molecular sieve operating in accordance with a temperature and/or pressure swing adsorption cycle in which moisture and other impurities, such as carbon dioxide, water vapor and hydrocarbons, are adsorbed.

The resultant compressed and purified feed air stream 18 is then divided into a first stream 20 and a second stream 22. Typically, first stream 20 is between about 25 percent and about 35 percent by volume of the compressed and purified feed stream 18 and the remainder is diverted as second stream 22.

First stream 20 is then further compressed within a compressor 23 which again preferably comprises another intercooled, integral gear compressor. This second compressor 23 further compresses the first stream 20 to a pressure between about 25 bar(a) and about 70 bar(a) to produce a compressed stream 24. The compressed stream 24 is directed or introduced into main heat exchanger 3 where it is cooled and liquefied at the cold end of main heat exchanger 3 to produce a first liquid stream 25. The liquid stream 25 is then partially expanded in an expansion valve 45 and divided into liquid streams 46 and 48 for eventual introduction into the air separation unit 50.

As illustrated, second stream 22 is further compressed by a turbine loaded booster compressor 26 and yet further compressed by a second booster compressor 28 to a pressure that can be in the range from between about 20 bar(a) to about 60 bar(a) to produce compressed stream 30. Compressed stream 30 is also directed or introduced into main heat exchanger 3 in which it is partially cooled to a temperature in a range of between about 160 and about 220 Kelvin to form a partially cooled stream 31 that is subsequently introduced into a turboexpander 32 to produce an exhaust stream 34 that is introduced into the air separation unit 50. As can be appreciated by those skilled in the art, the compression of second stream 22 could take place in a single compression machine. Turboexpander 32 is preferably linked with booster compressor 26, either directly or by appropriate gearing.

The aforementioned components of the feed air streams, namely oxygen and nitrogen, are separated within an air separation unit 50 that consists of a higher pressure column 52 and a lower pressure column 54. It is understood that if argon were a necessary product, an argon column could be incorporated into the distillation column unit. The higher pressure column 52 typically operates in the range from between about 20 bar(a) to about 60 bar(a) whereas the lower pressure column 54 typically operates at between about 1.1 to about 1.5 bar(a).

The higher pressure column 52 and the lower pressure column 54 are linked in a heat transfer relationship such that a nitrogen-rich vapor column overhead, extracted from the top of higher pressure column 52 as a stream 56, is condensed within a condenser-reboiler 57 located in the base of lower pressure column 54 against boiling an oxygen-rich liquid column bottoms 58. The boiling of oxygen-rich liquid column bottoms 58 initiates the formation of an ascending vapor phase within lower pressure column 54. The condensation produces a liquid nitrogen containing stream 60 that is divided into streams 62 and 64 that reflux the higher pressure column 52 and the lower pressure column 54, respectively to initiate the formation of descending liquid phases in such columns.

Exhaust stream 34 is introduced into the higher pressure column 52 along with the liquid stream 46 for rectification by contacting an ascending vapor phase of such mixture within a plurality of mass transfer contacting elements, illustrated as contacting elements 66 and 68, with a descending liquid phase that is initiated by reflux stream 62. This produces a crude liquid oxygen column bottoms 70, also known as kettle liquid and the nitrogen-rich column overhead. A stream 72 of the crude liquid oxygen column bottoms 70 is expanded in an expansion valve 74 to the pressure at or near that of the lower pressure column 54 and is introduced into the lower pressure column for further rectification. Second liquid stream 48 is passed through an expansion valve 76, expanded to the pressure at or near that of the lower pressure column 54 and then introduced into lower pressure column 54.

Lower pressure column 54 is also provided with a plurality of mass transfer contacting elements, illustrated as contacting elements 78, 80, 82 and 84 that can be trays or structured packing or random packing or other known elements in the art of cryogenic air separation. As stated previously, the separation produces an oxygen-rich liquid 58 and a nitrogen-rich vapor column overhead that is extracted as a nitrogen product stream 86. Additionally, a waste stream 88 is also extracted to control the purity of nitrogen product stream 86. Both nitrogen product stream 86 and waste stream 88 are passed through a subcooling unit 90 designed to subcool the reflux stream 64. A portion of the reflux stream 64 may optionally be taken as a liquid product stream 92 and the remaining portion (shown as stream 93) may be introduced into lower pressure column 54 after passing through expansion valve 94.

After passage through subcooling unit 90, nitrogen product stream 86 and waste stream 88 are fully warmed within main heat exchanger 3 to produce a warmed nitrogen product stream 95 and a warmed waste stream 96. Although not shown, the warmed waste stream 96 may be used to regenerate the adsorbents within prepurification unit 16. In addition, an oxygen-rich liquid stream 98 is extracted from the oxygen-rich liquid column bottoms 58 near the bottom of the lower pressure column 54. Oxygen-rich liquid stream 98 can be pumped by a pump 99 to form a pumped product stream as illustrated by pumped liquid oxygen stream 100. Part of the pumped liquid oxygen stream 100 can optionally be taken directly as a liquid oxygen product stream 102, with the remainder (streams 104) directed to the main heat exchanger 3 where it is warmed and vaporized to produce a pressurized oxygen product stream 106. Preferably, the remainder (stream 104) of the pumped liquid oxygen stream is divided into first and second subsidiary streams 104*a* and 104*b*. Although only two such streams 104*a* and 104*b* are shown, there could be a series of such streams that are fed into the main heat exchanger 3. Pumped liquid oxygen stream 100 can be pressurized to above or below the critical pressure so that oxygen product stream 106 when discharged from the main heat exchanger 3 will be a supercritical fluid. Alternatively, the pressurization of pumped liquid oxygen stream 100 could be lower to produce a oxygen product stream 106 in a vapor form.

The main heat exchanger 3 may be comprised of one or more heat exchangers of brazed aluminum plate-fin type construction. Such heat exchangers are advantageous due to their compact design, high heat transfer rates and their ability to process multiple streams. They are manufactured as fully brazed and welded pressure vessels. The brazing operation involves stacking corrugated fins, parting sheets and end bars to form a core matrix. The matrix is placed in a vacuum brazing oven where it is heated and held at brazing temperature in a clean vacuum environment. For small plants, a heat exchanger comprising a single core may be sufficient. For higher flows, a heat exchanger may be constructed from several cores which must be connected in parallel or series.

As indicated above, air separation plant 1 is capable of producing liquid products, namely, nitrogen-rich liquid stream 92 and liquid oxygen product stream 102. In order to increase the production of such liquid products, additional refrigeration is supplied by the supplemental refrigeration circuit or system 2. Likewise, when less liquid product is needed, the supplemental refrigeration circuit 2 should be turned down so as to provide less supplemental refrigeration, but without completely shutting down.

By modifying the operation and control of the supplemental refrigeration circuit or system, the basic supplemental refrigeration cycle can be improved. In particular, it has been found that compressors and turboexpanders typically used in such supplemental refrigeration systems can maintain efficiencies and operating speeds that are very stable over very large pressure ranges, provided the pressure ratios and volumetric flow rates are held generally constant. If one were able to maintain the pressure ratios and volumetric flow rates through the compressors and turboexpanders of the supplemental refrigeration system at substantially constant levels, the power generated becomes proportional to the absolute pressure and hence the mass flow at the inlet of the system.

The supplemental refrigeration circuit 2 uses a compressible working fluid or refrigerant such as air which is compressed in a multi-stage compression section 115. Preferably, the working fluid or refrigerant stream 114*a* within the closed loop supplemental refrigeration circuit 2 is compressed in a first compressor 116 and then fed to a second booster compressor 118 coupled to a turboexpander 124. The compressed working fluid or refrigerant stream 122 may then be cooled using an aftercooler 120 to remove the heat of compression prior to expansion in turboexpander 124. Preferably, the aftercooler 120 cools the compressed working fluid stream 122 to ambient or a chilled temperature by means of chilled water or other refrigeration source associated with the air separation plant. Such aftercooling generally improves cycle efficiency and prevents damage to the turboexpander 124 due to high temperatures.

The turboexpander 124 is configured to expand the compressed working fluid stream 122 to generate a cooled working fluid stream 114*b*. The cooled working fluid stream 114*b* is then warmed in the main heat exchanger 3 so as to impart a portion of the refrigeration required by the air separation plant 1 to produce the nitrogen and oxygen liquid product streams 92 and 102. The warmed working fluid stream 114*a* is recirculated back to the compressor section 115 after having passed through the main heat exchanger 3. As indicated above, the turboexpander 124 is preferably linked with booster compressor 118, either directly or by appropriate gearing.

Although not shown, the turboexpander may to be connected or operatively coupled to a generator. Such generator loaded turboexpander arrangement allows the speed of the turboexpander to be maintained constant even at very high or low loads. This arrangement is desirable in some applications because the speed of the turboexpander would remain generally constant at the ideal efficiency across the entire operating envelope and the control methods of the turboexpander, as discussed in more detail below, would be further simplified. In such arrangements, the generator load may be connected to the turboexpander by means of a high speed generator. Alternatively, the generator load may be connected to the turboexpander by means of a high speed coupling connected to an internal or external gearbox and with a low speed coupling from the gearbox to the generator.

As illustrated, the source of the working fluid or refrigerant stream 114*a* is the compressed and purified feed air stream 18, a portion of which is diverted as charge stream 110 to the supplemental refrigeration circuit or system 2 upstream of the compressor 116. Working fluid may be added via one or more inlet valves 112 and 142 operatively disposed between the compressed purified feed air stream 18 and the supplemental refrigeration circuit 2 that are open and closed, as required, to maintain a substantially constant volumetric flow rate of the working fluid through the compressors 116, 118 and turboexpander 124 and a substantially constant pressure ratio across the compressor section. Inlet valves 112 and 142 are controllably operated to set the inlet pressure of the compressor 116 and hence outlet pressure of the turboexpander 124. Inlet valve 112 is preferably larger of the two inlet valves and is used to charge or pressurize the supplemental refrigeration circuit or opened when rapid change in the inlet pressure is needed whereas inlet valve 142 provides continuing adjustment to the pressure in the supplemental refrigeration circuit 2. In this manner, increasing the inlet pressure in the supplemental refrigeration circuit 2 can increase the power provided by equipment and hence the refrigeration imparted to the main heat exchanger 3 thereby allowing for a higher liquid make rate. Conversely, decreasing the pressure in the supplemental refrigeration circuit 2 will decrease the power and lower the refrigeration imparted to the main heat exchanger 3 thereby reducing the liquid make rate.

In addition, working fluid to may be added to the supplemental refrigeration circuit 2 by means of a low pressure make-up supply of refrigerant provided via valve 143 upstream of the compressor 116 to maintain a minimum pressure in the supplemental refrigeration circuit 2. Generally valve 143 will open if a minimum pressure in the supplemental refrigeration circuit 2 is not maintained, as may occur during typical shutdown operation.

The supplemental refrigeration circuit 2 also includes a vent system 140 comprising a valve 144 and vent 145 disposed upstream of the turboexpander 124. The vent system 140 is configured to removing a portion of the working fluid or refrigerant in the supplemental refrigeration circuit 2 when the pressure is above the desired or targeted pressure so as to maintain the substantially constant volumetric flow rate and substantially constant pressure ratios. An auxiliary vent arrangement including valves 146, 147 and vent 148 are optionally disposed downstream of the turboexpander 124 and upstream of the main heat exchanger 3 that typically opens during startup to allow the circuit, including turboexpander 124 and associated piping to cool down during startup.

Using a controller 150 to add or remove working fluid, the degree to which supplemental refrigeration is supplied to main heat exchanger 3 can be generally controlled. As seen in the FIGURE, the illustrated controller 150 is preferably a master PLC type control unit operatively connected to local PID controllers (not shown) that control the vent system valve 144, and inlet valves 112, 142 to adjust or control the removal or addition of working fluid in the supplemental refrigeration circuit 2 while maintaining a substantially constant volumetric flow rate of the working fluid through compressor and turboexpander sections of the supplemental refrigeration circuit and a substantially constant pressure ratio across the compressor section. While shown as a master PLC-type control, it is contemplated that such controller can also be a manual or operator based controller. Adjusting the setpoints for the vent system valve 144 and/or inlet valves 112, 142 changes the inlet pressure to the supplemental refrigeration circuit 2 and as indicated above, either: (i) increases the supplemental refrigeration and thereby increases liquid product make rate in the air separation plant; or (ii) decreases supplemental refrigeration and thereby decreases the liquid product make rate in the air separation plant.

In addition, the controller 150 or other suitable control means is adapted or configured to control the adjustments to the inlet guidevanes on compressor 116 and/or compressor 118 as well as the turbine nozzle arrangements in the turboexpander 124. Adjustments of the turbine nozzles are controlled to maintain substantially constant volumetric flow rates over wide pressure variations. The turbine nozzles are also adjusted to keep the pressure ratio over the turboexpander 124 generally constant. Adjustment of the compressor inlet guidevanes on one or both of the compressors 116, 118 helps maintain the substantially constant pressure ratio across the compressors, and more particularly, makes necessary adjustments to correct for effects such as compressibility of the working fluid, changes in inlet temperature and mismatches with the turbine nozzles.

The preferred method of operating an air separation plant with the disclosed supplemental refrigeration circuit comprises the steps of: (i) conducting a cryogenic rectification process in an air separation plant to produce liquid nitrogen and/or liquid oxygen; (ii) providing a portion of the refrigeration required by the air separation plant to produce the liquid product stream via the supplemental refrigeration circuit, as described above; (iii) warming the refrigerant or cooled working fluid from the supplemental refrigeration circuit in the main heat exchanger associated with the air separation plant; (iv) recirculating the warmed working fluid back through the supplemental refrigeration circuit; and (v) removing or adding working fluid to the supplemental refrigeration circuit to adjust the inlet pressure in the supplemental refrigeration circuit while maintaining substantially constant volumetric flow rate of the working fluid and substantially constant pressure ratios in the supplemental refrigeration circuit.

Adjusting the inlet guidevanes in the compressors in the supplemental refrigeration circuit and/or the turbine nozzles in the turboexpander in the supplemental refrigeration circuit optimizes the pressure ratios and constant volume flows, respectively. Adding the additional mass flow of the refrigerant or working fluid ultimately allows for the increase in the supplemental refrigeration and thereby allows for increasing the liquid product make rate in the air separation plant. Conversely, removing the refrigerant or working fluid generally decreases the supplemental refrigeration and thereby decreases the liquid product make rate in the air separation plant.

Although the present invention has been discussed with reference to preferred embodiments, as would occur to those skilled in the art that numerous changes and omissions can be made without departing from the spirit and scope of the present invention as set forth in the appended claims.

What is claimed is:

1. A method of separating air comprising the steps of:

conducting a cryogenic rectification process in an air separation plant comprising a main heat exchanger to cool a compressed and purified feed air stream to a temperature suitable for the rectification of the feed air stream and a distillation column system configured to rectify the compressed, purified and cooled air to produce at least one liquid product stream;

providing a portion of the refrigeration required by the air separation plant to produce the at least one liquid product stream via a supplemental refrigeration circuit, the supplemental refrigeration circuit comprising a working fluid comprising a portion of the compressed and purified feed air stream; a compressor section configured to compress the working fluid; and a turboexpander section configured to expand the working fluid to generate cooled working fluid, the supplemental refrigeration circuit configured to direct the cooled working fluid through the main heat exchanger;

warming the cooled working fluid in the main heat exchanger to impart the portion of the refrigeration required by the air separation plant;

recirculating the working fluid to the compressor section of the supplemental refrigeration circuit after having passed through the main heat exchanger; and removing a portion of the working fluid in the supplemental refrigeration circuit upstream of the turboexpander section thereby decreasing the refrigeration imparted by the supplemental refrigeration circuit and the production of the at least one liquid product stream and adding working fluid to the supplemental refrigeration circuit upstream of the compressor section thereby increasing the refrigeration imparted by the supplemental refrigeration circuit and the production of the at least one liquid product stream;

wherein the removal of the working fluid from the supplemental refrigeration circuit and the adding of the working fluid to the supplemental refrigeration circuit being conducted in a manner such that the inlet pressure within the supplemental refrigeration circuit is adjusted commensurate with the desired production of the liquid product stream; the working fluid circulates within the supplemental refrigeration circuit at a substantially constant volumetric flow rate; and the pressure ratio across the compressor section is maintained substantially constant.

2. The method of claim 1 wherein the step of removing a portion of the working fluid in the supplemental refrigeration circuit upstream of the turboexpander section further comprises venting a portion of the working fluid to maintain the working fluid in the supplemental refrigeration circuit at or below a prescribed maximum pressure.

3. The method of claim 1 further comprising the step of venting a portion of the working fluid downstream of the turboexpander section of the supplemental refrigeration circuit to maintain the working fluid in the supplemental refrigeration circuit at or below a prescribed maximum pressure and to maintain the cooled working fluid directed to the main heat exchanger at or below a prescribed maximum temperature.

4. The method of claim 1 wherein the step of adding working fluid to the supplemental refrigeration circuit upstream of the compressor section further comprises adding a flow of make-up working fluid to the supplemental refrigeration circuit to maintain the inlet pressure to the compressor section at or above a prescribed minimum pressure.

5. The method of claim 1 wherein the step of adding working fluid to the supplemental refrigeration circuit upstream of the compressor section further comprises modulating the supply of the working fluid charge to the supplemental refrigeration circuit to adjust the inlet pressure of the compressor section.

6. The method of claim 1 further comprising the step of adjusting compressor guidevanes in the compressor section to maintain the substantially constant pressure ratio across the compressor section.

7. The method of claim 6 further comprising the step of adjusting turbine nozzles in the turboexpander section to maintain substantially constant volumetric flow rate in the supplemental refrigeration circuit.

8. The method of claim 7 further comprising the step of operatively controlling the amount of supplemental refrigeration required by the air separation plant to produce the at least one liquid product stream by controlling the removal of working fluid, the addition of working fluid, the adjusting of compressor guidevanes, and the adjusting of turbine nozzles via a controller to maintain a substantially constant pressure ratio across the compressor section and substantially constant volumetric flow rate in the supplemental refrigeration circuit.

9. The method of claim 1 wherein the step of conducting the cryogenic rectification process further comprises the steps of:

compressing and purifying an air feed stream to produce the compressed and purified feed air stream;

dividing the compressed and purified feed air stream into a first compressed air stream and a second compressed air stream;

further compressing, cooling, and expanding the first compressed air stream and second compressed air stream to form a first intake liquid stream and a second intake stream, respectively, and introducing the first intake liquid stream and a second intake stream to the distillation column system; and fractionally distilling the intake streams into their component parts in the distillation column system to produce a plurality of product and waste streams, including the at least one liquid product stream.

* * * * *